US012312992B2

(12) United States Patent
Yamashita

(10) Patent No.: US 12,312,992 B2
(45) Date of Patent: May 27, 2025

(54) CONTROL DEVICE FOR INTERNAL COMBUSTION ENGINE

(71) Applicant: TOYOTA JIDOSHA KABUSHIKI KAISHA, Toyota (JP)

(72) Inventor: Hideo Yamashita, Mishima (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/780,725

(22) Filed: Jul. 23, 2024

(65) Prior Publication Data

US 2025/0129735 A1 Apr. 24, 2025

(30) Foreign Application Priority Data

Oct. 20, 2023 (JP) ..... 2023-181246

(51) Int. Cl.
*F01P 3/08* (2006.01)

(52) U.S. Cl.
CPC ..... *F01P 3/08* (2013.01)

(58) Field of Classification Search
CPC ..... F01P 3/08; F01P 7/14; F01P 7/167; F01P 2007/146; F02F 3/22; F02F 3/225; F02F 3/20; F01M 1/08; F01M 1/16
See application file for complete search history.

(56) References Cited

U.S. PATENT DOCUMENTS

| | | | | |
|---|---|---|---|---|
| 10,309,290 | B2 * | 6/2019 | Yamashita | F01M 1/08 |
| 11,391,197 | B1 * | 7/2022 | Park | F01P 3/08 |
| 2010/0031917 | A1 * | 2/2010 | Abe | F01M 1/08 123/196 R |
| 2013/0179049 | A1 * | 7/2013 | Grieser | F01M 1/08 701/102 |
| 2017/0030292 | A1 * | 2/2017 | Linke | F01P 3/10 |
| 2017/0350304 | A1 | 12/2017 | Yamashita | |

FOREIGN PATENT DOCUMENTS

JP 2017-218912 A 12/2017

* cited by examiner

*Primary Examiner* — Grant Moubry
(74) *Attorney, Agent, or Firm* — SoraIP, Inc.

(57) ABSTRACT

The internal combustion engine includes a first oil jet that injects oil toward an inflow hole for flowing oil into the cavity, and a second oil jet that injects oil to a back surface so that the oil does not flow into the cavity. The control device of the internal combustion engine determines whether the temperature of the piston is equal to or higher than a specified temperature which is a threshold value for determining whether the piston has overheated to the extent that cooling is required. When the temperature of the piston is equal to or higher than the specified temperature, the control device cools the piston by using the first oil jet. When the temperature of the piston is lower than the specified temperature, the control device restricts the injection of the oil from the first oil jet and warms up the oil using the second oil jet.

4 Claims, 5 Drawing Sheets

CONTROL DEVICE FOR INTERNAL COMBUSTION ENGINE

CROSS-REFERENCE TO RELATED APPLICATION

This application claims priority to Japanese Patent Application No. 2023-181246 filed on Oct. 20, 2023, incorporated herein by reference in its entirety.

BACKGROUND

1. Technical Field

The present disclosure relates to a control device for an internal combustion engine.

2. Description of Related Art

Japanese Unexamined Patent Application Publication No. 2017-218912 (JP 2017-218912 A) discloses a control device for an internal combustion engine including a first oil jet and a second oil jet. To cause oil to flow into a cavity extending through a piston, the first oil jet sprays the oil toward a hole that is continuous with the cavity and is open to the back surface of the piston. The second oil jet sprays the oil to a portion different from the hole on the back surface of the piston. The control device can appropriately maintain the temperature of the piston by using the first oil jet and the second oil jet in combination.

SUMMARY

For example, when the water content in the oil is high, the oil is likely to be emulsified to form an emulsion. In such a case, the emulsion may occlude the cavity. Therefore, cooling using the first oil jet cannot be realized.

Hereinafter, means for solving the above problem and its operations and effects will be described.

According to an aspect of the present disclosure, a control device for an internal combustion engine is provided. The control device includes:

- a first oil jet configured to spray, to cause oil to flow into a cavity extending through a piston, the oil toward a hole that is continuous with the cavity and is open to a back surface of the piston;
- a second oil jet configured to spray the oil to a portion different from the hole on the back surface of the piston; and
- a processing circuit. The processing circuit is configured to:
  - acquire a temperature of the piston;
  - determine whether the acquired temperature of the piston is equal to or higher than a predetermined temperature;
  - execute a first process for spraying the oil from the first oil jet when the acquired temperature of the piston is equal to or higher than the predetermined temperature; and
  - execute a second process for restricting the spraying of the oil from the first oil jet and spraying the oil from the second oil jet when the acquired temperature of the piston is lower than the predetermined temperature.

While the temperature of the piston is lower than the predetermined temperature, the occlusion of the cavity by the oil that has formed the emulsion can be suppressed and the oil can be warmed up.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
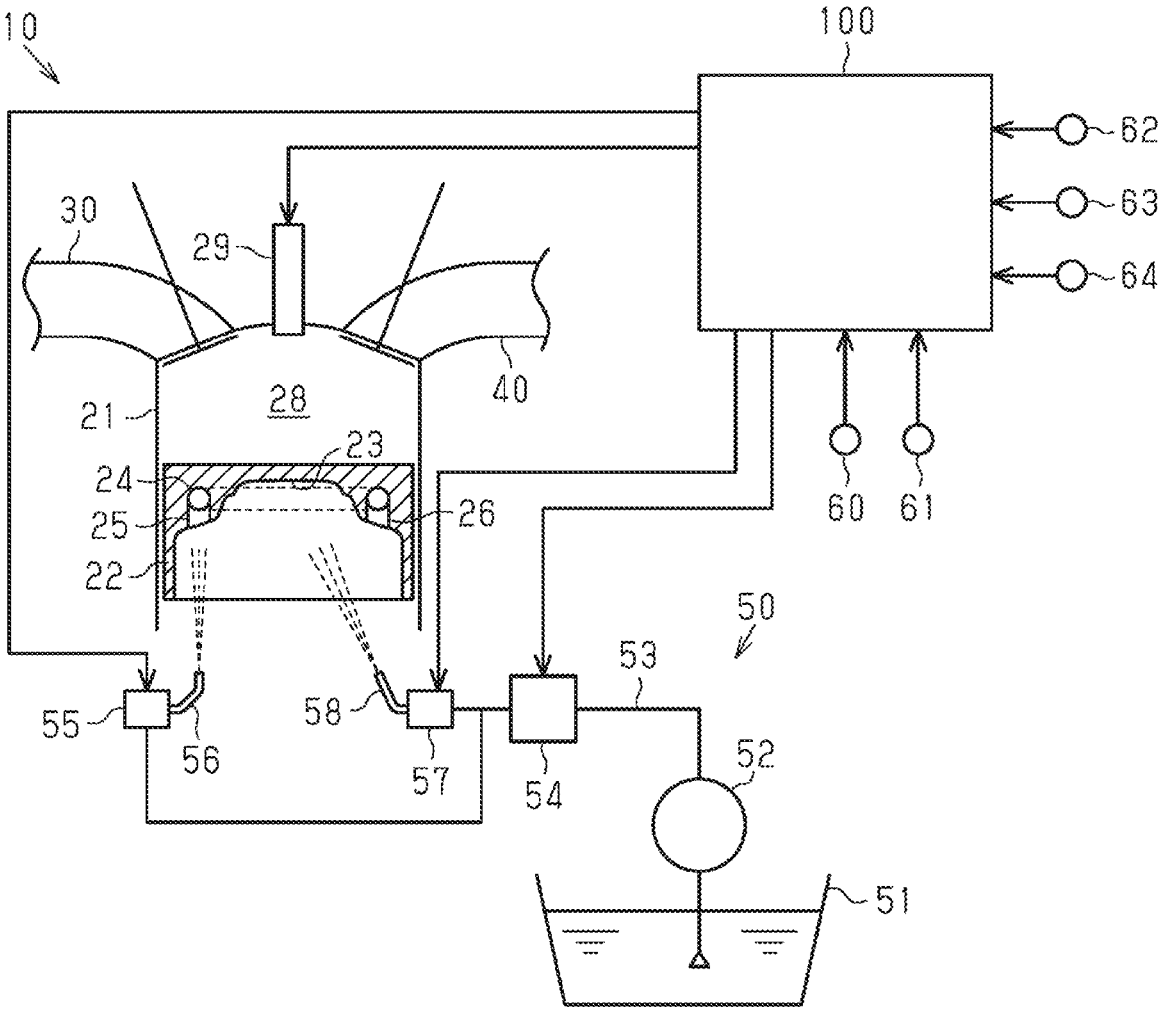
FIG. 1 is a schematic diagram illustrating a relationship between a control device of an internal combustion engine and an internal combustion engine.

Hereinafter, an embodiment of a control device for an internal combustion engine will be described referring to the drawings.

Control Device 100 of Internal Combustion Engine 10 and Overview of Internal Combustion Engine 10

The internal combustion engine 10 shown in FIG. 1 includes a plurality of cylinders 21. In FIG. 1, only one of the plurality of cylinders 21 is illustrated. In each cylinder 21, a piston 22 reciprocates. Each of the pistons 22 is connected to a crankshaft via a connecting rod. A region above the piston 22 in the cylinder 21 is a combustion chamber 28.

A cavity 24 extends through the interior of the piston 22. The cavity 24 is a so-called cooling channel. The cavity 24 is a torus-shaped oil flow path for cooling the piston 22. An inflow hole 25 is continuous with the cavity 24 and opens into the back surface 23 of the piston 22. An outflow hole 26 is continuous with the cavity 24 and opens into the back surface 23 of the piston 22. The oil jetted from the first oil jet 56 described later flows into the cavity 24 through the inflow hole 25. The oil flowing through the cavity 24 flows out of the piston 22 through the outflow hole 26.

In each of the combustion chambers 28, an air-fuel mixture including the intake air introduced through the intake passage 30 and the fuel injected from the fuel injection valve 29 is combusted. The fuel is, for example, hydrogen, gasoline, or light oil. The exhaust gas generated in each combustion chamber 28 by the combustion of the air-fuel mixture is discharged to the exhaust passage 40.

Further, the internal combustion engine 10 is provided with an oil supply device 50 that operates to circulate oil in the internal combustion engine 10. The oil supply device 50 includes an oil pump 52 that pumps oil from the inside of the oil pan 51. The oil supply device 50 includes a first oil jet 56 that injects oil toward the inflow hole 25 to flow oil into the cavity 24. The oil supply device 50 includes a second oil jet 58 that injects oil into a portion of the back surface 23 of the piston 22 that is different from the inflow hole 25 and the outflow hole 26 so that the oil does not flow into the cavity 24.

The oil supply device 50 supplies the oil pumped up by the oil pump 52 to the respective parts of the internal combustion engine 10 through the oil supply passage 53. The oil supply passage 53 is provided with a first solenoid valve 55 for stopping the injection of oil from the first oil jet 56 by shutting off the supply of oil to the first oil jet 56. The oil supply passage 53 is provided with a second solenoid valve 57 for stopping the injection of oil from the second oil jet 58 by shutting off the supply of oil to the second oil jet 58. The oil supply passage 53 is provided with a blocking mechanism 54 positioned upstream of the first solenoid valve 55 and the second solenoid valve 57. The blocking mechanism 54 is capable of blocking the supply of oil to the first oil jet 56 and the second oil jet 58.

Control device 100 includes a CPU, RAM and a ROM. The control device 100 operates the first solenoid valve 55 to stop the injection of the oil from the first oil jet 56 or to inject the oil from the first oil jet 56. The control device 100 operates the second solenoid valve 57 to stop the injection of the oil from the second oil jet 58 or to inject the oil from the second oil jet 58.

When blocking device 54 blocks the supply of oil to the first oil jet 56 and the second oil jet 58, the oil is not supplied to the first oil jet 56 and the second oil jet 58 even when the oil pump 52 is in operation. This prevents oil from being injected from both the first oil jet 56 and the second oil jet 58 regardless of the states of the first solenoid valve 55 and the second solenoid valve 57.

A control device 100 for controlling each unit of internal combustion engine 10 receives signals from various sensors described below. The crank angle sensor 60 detects a rotation angle of the crankshaft. The control device 100 detects the engine rotation speed that is the rotation speed of the crankshaft based on the rotation angle detected by the crank angle sensor 60. The air flow meter 61 detects an intake air amount which is an amount of air sucked into the combustion chamber 28 of the internal combustion engine 10. The oil temperature sensor 62 detects the temperature of the oil in the internal combustion engine 10. The oil temperature sensor 62 may be provided in the oil pan 51 or the oil supply passage 53, for example. The oil water sensor 63 detects the water content in the oil in the internal combustion engine 10. The water temperature sensor 64 detects the temperature of the engine coolant that cools the internal combustion engine 10. The control device 100 executes various kinds of control illustrated in FIGS. 2 to 4 based on output signals of various kinds of sensors.

Processing Executed by Control Device 100

Figure 2:
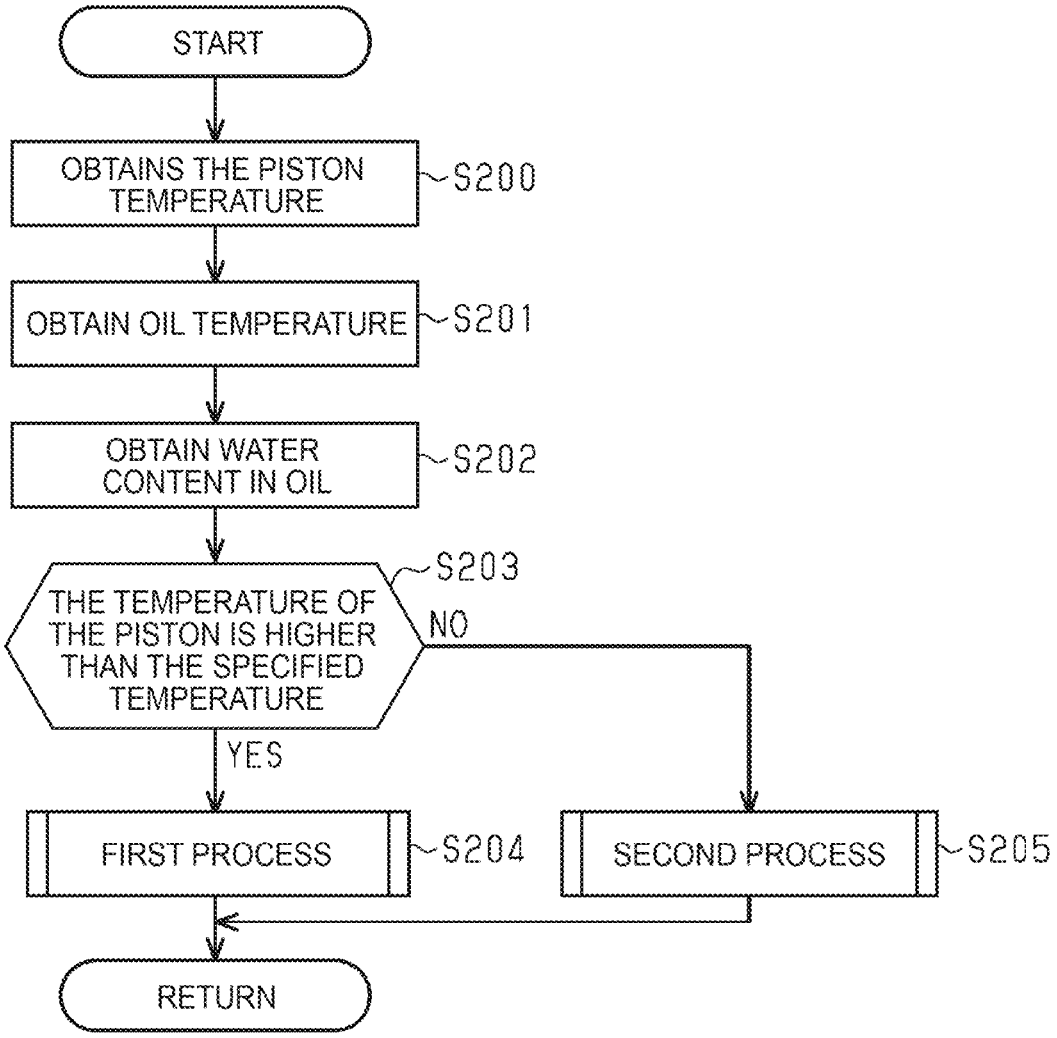
FIG. 2 is a flowchart showing a process executed by the control device of FIG. 1.
Figure 3:
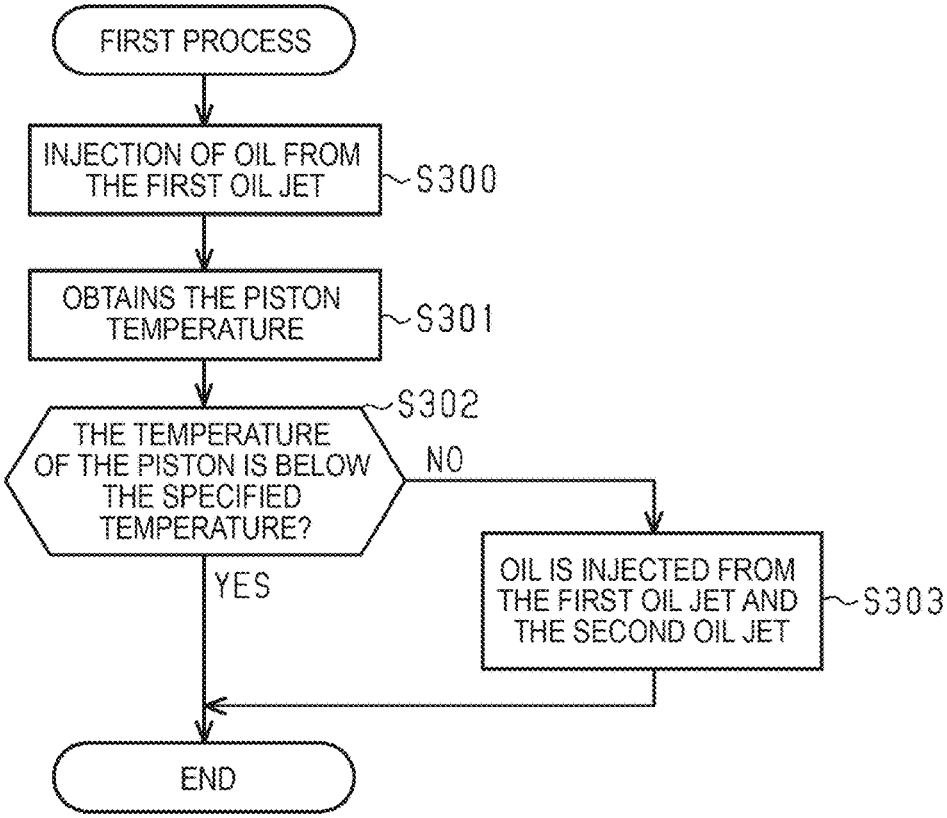
FIG. 3 is a flowchart illustrating the first process described in FIG. 2.
Figure 4:
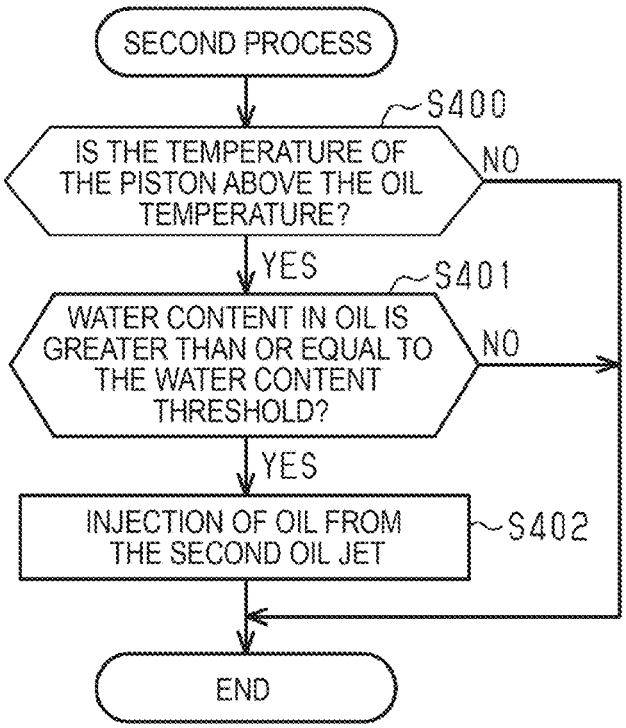
FIG. 4 is a flowchart illustrating the second process described in FIG. 2.

Referring to FIGS. 2 to 4, a process executed by the control device 100 will be described. The control device 100 starts the process illustrated in FIG. 2 when the ignition switch is switched from OFF to ON. The control device 100 repeatedly executes the process illustrated in FIG. 2 while the ignition switch is ON.

Control device 100 obtains the temperature of the piston 22 in S200. Specifically, the control device 100 acquires the temperature of the piston 22 using the temperature map. The temperature map is a map representing the relationship between the engine speed and the engine load factor and the temperature of the piston 22. The engine load factor is a value indicating a ratio of the current intake air amount to the maximum value of the intake air amount corresponding to the engine rotation speed. Therefore, when the intake air amount is equal to the maximum value, the engine load factor becomes "100%".

Control device 100 acquires the temperature of the oil from the oil temperature sensor 62 in S201. In S202, the control device 100 acquires the water content in the oil from the oil water sensor 63.

In S203, control device 100 determines whether or not the acquired temperature of the pistons 22 is equal to or higher than a specified temperature. The defined temperature is a threshold value for determining whether or not the piston 22 has overheated to a degree that requires cooling. When the obtained temperature of the pistons 22 is equal to or higher than the specified temperature (S203: YES), the control device 100 advances the process to S204. In S204, the control device 100 performs a first process of injecting oil from the first oil jet 56, flowing oil into the cavity 24, and cooling the piston 22. The first process will be described later with reference to FIG. 3. When the obtained temperature of the pistons 22 is lower than the specified temperature (S203: NO), the control device 100 advances the process to S205. The control device 100 executes the second process in S205. In the second process, the injection of the oil from the first oil jet 56 is restricted, and the oil is injected from the second oil jet 58 to heat-exchange the oil with the piston 22, thereby warming up the oil. The second process will be described later with reference to FIG. 4. Upon completion of S204 or S205 process, the control device 100 terminates the process of FIG. 2.

Referring to FIG. 3, the first process will be described. In S300, the control device 100 injects oil from the first oil jet 56. The injection of the oil takes place, for example, over a period of several seconds. The control device 100 then obtains the temperature of the piston 22 in S301. Next, the control device 100 determines, in S302, whether the temperature of the pistons 22 is equal to or lower than the specified temperature. This is done to determine if the injection of oil from the first oil jet 56 performed in S300 has caused the piston 22 to cool sufficiently. When the temperature of the pistons 22 is equal to or lower than the specified temperature (S302: YES), the control device 100 ends the process of FIG. 3. If the temperature of the pistons 22 is higher than the specified temperature (S302: NO), the control device 100 proceeds to S303. In S303, the control device 100 injects oil from the first oil jet 56 and the second oil jet 58. Upon completion of S303, the control device 100 terminates the process of FIG. 3.

Referring to FIG. 4, the second process will be described. In S400, the control device 100 determines whether the temperature of the pistons 22 is equal to or higher than the temperature of the oil. When a negative determination is made in S400 (S400: NO), the control device 100 ends the process of FIG. 4. When an affirmative determination is made in S400 (S400: YES), the control device 100 advances the process to S401. In S401, the control device 100 determines whether or not the water content in the oil is equal to or greater than the water content threshold. The moisture content threshold is, for example, 10%. The moisture content threshold value is set in advance as a threshold value for determining whether or not it is desirable to remove moisture from the oil. When a negative determination is made in S401 (S401: NO), the control device 100 ends the process of FIG. 4. When an affirmative determination is made in S401 (S401: YES), the control device 100 advances the process to S402. In S402, the control device 100 injects oil from the second oil jet 58. The injection of the oil takes place, for example, over a period of several seconds. According to S402 from S400, the injection of the oil from the second oil jet 58 in the second process is performed when the logical AND condition consisting of the following condition (A) and condition (B) is satisfied. The condition (A) is a condition that the temperature of the piston 22 is equal to or higher than the temperature of the oil. Condition (B) is a condition that the moisture content in the oil is equal to or higher than the moisture content threshold value. Upon completion of S402, the control device 100 terminates the process of FIG. 4.

Operation of this Embodiment

Figure 5:
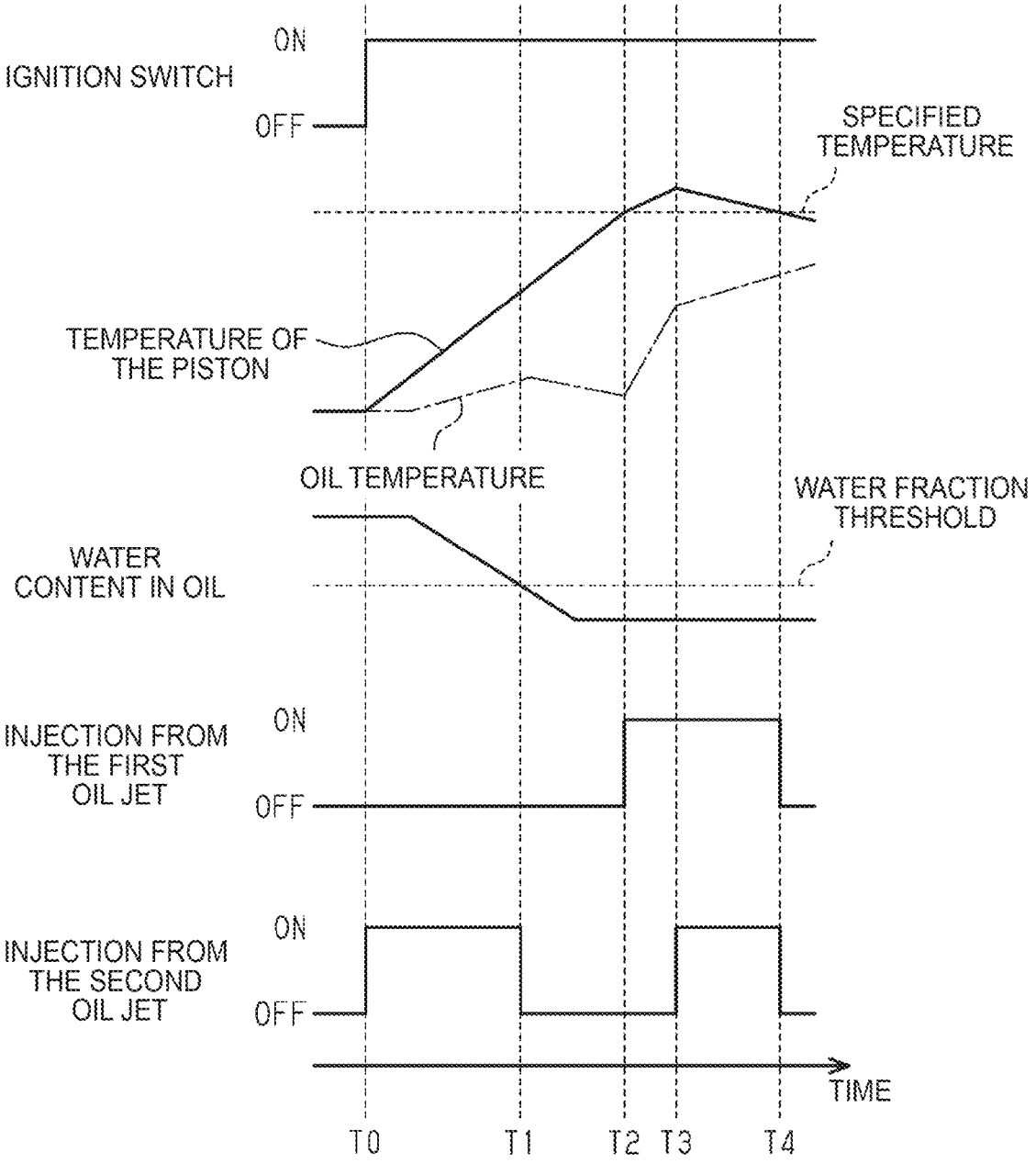
FIG. 5 is a timing chart for explaining the operation.

Referring to FIG. 5, the operation of the present embodiment will be described. At time T0, the ignition switch is switched from OFF to ON. Therefore, the temperature of the piston 22 starts to increase from the time T0. Further, the control device 100 starts the process illustrated in FIG. 2 from the time T0. Immediately after the time T0, since the temperature of the pistons 22 is lower than the specified temperature (S203: NO), the control device 100 executes S205 and the second process illustrated in FIG. 4. Between the time T0 and the time T1, the temperature of the pistons 22 is equal to or higher than the temperature of the oil (S400: YES), and the water fraction in the oil is equal to or higher than the water fraction threshold (S401: YES). Thus, oil is injected from the second oil jet 58 between the time T0 and the time T1.

At time T1, the water content in the oil is at the water content thresholds. After the time T1, the water content in the oil is less than the water content threshold. Further, from the time T1 to the time T2, the temperature of the pistons 22 is less than the specified temperature. Therefore, in the time T2 from the time T1, the control device 100 makes a negative determination in S203 and makes a negative determination in S401. Therefore, no oil is injected from the second oil jet 58 from the time T1 to the time T2.

At time T2, the temperature of the pistons 22 is at the specified temperature. Immediately after the time T2, since the temperature of the pistons 22 is equal to or higher than the specified temperature (S203: YES), the control device 100 executes S204 and the first process illustrated in FIG. 3. At the time T3, the control device 100 determines that the temperature of the pistons 22 is higher than the specified temperature (S302: NO). Therefore, immediately after the time T3, oil is injected from the first oil jet 56 and the second oil jet 58 (S303).

At time T4, the temperature of the pistons 22 is at the specified temperature. Immediately after the time T4, the temperature of the pistons 22 is below the specified temperature. Immediately after the time T4, the water fraction in the oil is below the water fraction threshold. Therefore, the control device 100 makes a negative determination in S203 and makes a negative determination in S401. This means that no oil is injected from the second oil jet 58.

Effect of This Embodiment (1) The internal combustion engine 10 includes a first oil jet 56 and a second oil jet 58 (FIG. 1). The first oil jet 56 is configured to inject oil into the cavity 24 extending through the interior of the piston 22 toward an inflow hole 25 which is continuous with the cavity 24 and opens into the back surface 23 of the piston 22. The second oil jet 58 is configured to inject oil into a portion of the back surface 23 of the piston 22 that is different from the inflow hole 25 and the outflow hole 26 so that the oil does not flow into the cavity 24. The control device 100 of the internal combustion engine 10 acquires the temperature of the piston 22 (S200), and determines whether or not the acquired temperature of the piston 22 is equal to or higher than a specified temperature that is a threshold for determining whether or not the piston 22 has overheated to a degree that requires cooling (S203). When the obtained temperature of the piston 22 is equal to or higher than the specified temperature, the control device 100 executes a first process of injecting oil from the first oil jet 56 and flowing oil into the cavity 24 to cool the piston 22 (S203: YES, S204, FIG. 3). When the obtained temperature of the piston 22 is lower than the specified temperature, the control device 100 performs a second process of limiting the injection of the oil from the first oil jet 56 and causing the oil and the piston 22 to be heat-exchanged by injecting the oil from the second oil jet 58 to warm up the oil (S203: NO, S205, FIG. 4).

If the temperature of pistons 22 is below the specified temperature, an emulsion of oil is likely to occur due to the high water content in the oil. In such a case, if oil is injected using the first oil jet 56, the cavity 24 may be blocked by the oil that has produced the emulsion. Therefore, it is desirable to remove moisture in the oil by warming the oil. According to the above embodiment, when the temperature of the piston 22 is less than the specified temperature, the injection of the oil using the first oil jet 56 is limited. Specifically, when the temperature of the piston 22 is lower than the specified temperature, the injection of oil using the first oil jet 56 is not performed. In addition, the second oil jet 58 ejects oil to the back surface 23 of the piston 22. Therefore, while the temperature of the piston 22 is lower than the predetermined temperature, it is possible to suppress the clogging of the cavity 24 and at the same time to warm the oil.

According to the control device 100 described above, the water in the oil can be removed while the temperature of the piston 22 is lower than the specified temperature. Therefore, when the temperature of the piston 22 becomes equal to or higher than the specified temperature, the first oil jet 56 can be rapidly cooled.

(2) The control device 100 is configured to S201 the temperature of the oil. Injecting oil from the second oil jet 58 in the second process is performed when the temperature of the piston 22 is equal to or higher than the temperature of the oil (S400: YES, S402).

According to the above embodiments, when the temperature of the pistons 22 is less than the temperature of the oil, the oil is not injected from the second oil jet 58 in the second process. Therefore, when the warm-up of the oil is not possible even if the oil is injected from the second oil jet 58, the oil is not injected from the second oil jet 58. Therefore, it is possible to prevent the oil from being unnecessarily injected from the second oil jet 58.

(3) The control device 100 is configured to S202 the water fraction in the oil. Injecting oil from the second oil jet 58 in the second process is executed if the water content in the oil is greater than or equal to the water content threshold (S401: YES, S402).

According to the above embodiments, when the water content in the oil is less than the water content threshold, the oil is not injected from the second oil jet 58 in the second process. Therefore, when the amount of water in the oil is small to such an extent that it is not necessary to remove the water from the oil, warm-up of the oil is not performed. Therefore, it is possible to prevent the oil from being unnecessarily injected from the second oil jet 58.

(4) In the second process illustrated in FIG. 4, the oil is not injected from the first oil jet 56. As described above, when the obtained temperature of the piston 22 is lower than the predetermined temperature, the control device 100 is configured to maintain the condition in which the injection of the oil from the first oil jet 56 is stopped during the second process (S203: NO, S205, FIG. 4).

According to the above embodiments, during the second process, the injection of the oil from the first oil jet 56 is not performed. Therefore, it is possible to eliminate the possibility that the cavity 24 is blocked by the oil in which the emulsion is generated as much as possible.

Example of Change

The embodiments can be modified as follows. The present embodiment and modification examples described below may be carried out in combination of each other within a technically consistent range.

In the above embodiments, the inflow hole 25 and the outflow hole 26 are continuously provided in the cavity 24. For example, the outflow hole 26 may be omitted. In such a case, the oil flowing in the cavity 24 through the inflow hole 25 flows out of the cavity 24 through the inflow hole 25.

In the above embodiments, the control device 100 uses the temperature map to obtain the temperature of the pistons 22. However, this is only an example. For example, the control device 100 may use the temperature of the engine coolant detected by using the water temperature sensor 64 as the temperature of the piston 22. Alternatively, for example, the control device 100 may use the temperature of the oil as the temperature of the piston 22.

S301, S302 and S303 may be omitted. In the above-described embodiment, the injection of the oil from the second oil jet 58 in the second process is performed when the logical AND condition consisting of the above-described condition (A) and condition (B) is satisfied. However, this is merely an example, and one or both of the condition (A) and the condition (B) may be omitted. That is, one or both of S400 and S401 may be omitted. Accordingly, one or both of S201 and S202 may be omitted.

Figure 6:
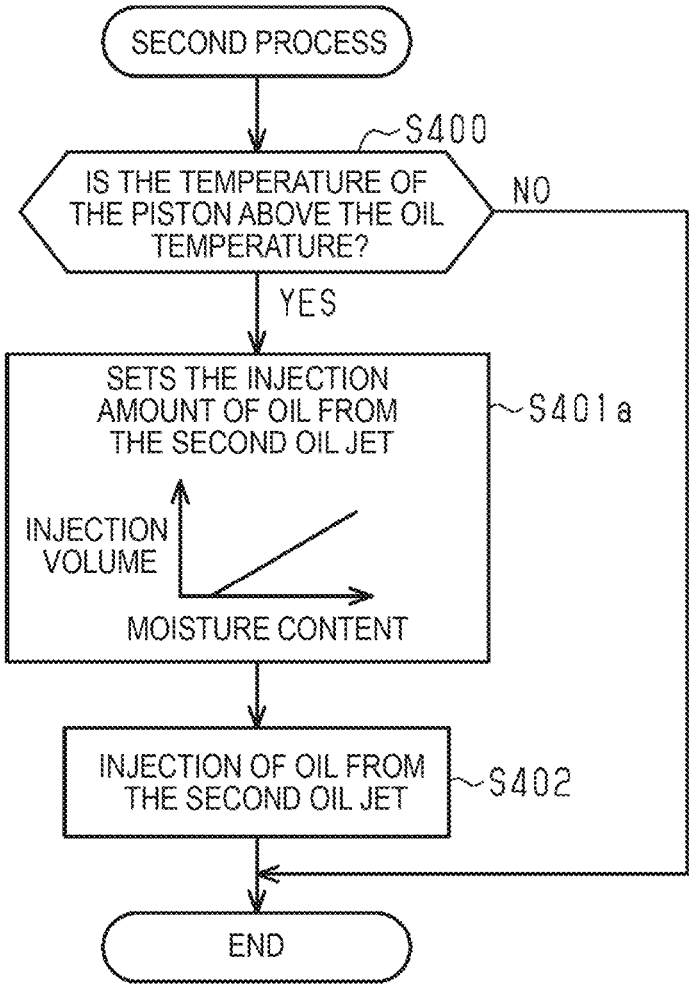
FIG. 6 is a flowchart illustrating a second process according to a modification example.

The process of S401*a* illustrated in and FIG. 6 may be executed instead of the process of S401 illustrated in FIG. 4. In S401*a*, the control device 100 sets the injection quantity of the oil from the second oil jet 58. This is done using a map representing the relationship between the moisture content in the oil and the injection amount of the oil from the second oil jet 58. The lower the moisture content in the oil, the lower the injection amount of the oil from the second oil jet 58 is set.

According to a variant of FIG. 6, the control device 100 is configured to obtain the water fraction in the oil (S202). The quantity of oil injected from the second oil jet 58 in the second process is S401*a* as compared to when the water content in the oil is lower.

When the water content in oil is low, the need to warm the oil by injecting the oil from the second oil jet 58 is low. According to the above configuration, the injection amount of the oil from the second oil jet 58 in the second process is limited more than when the water content in the oil is low. Therefore, it is possible to prevent the oil from being unnecessarily injected from the second oil jet 58 despite the low necessity of warming up the oil.

The control device 100 may restrict the number of cylinders 21 in which oil is injected from the second oil jet 58 in the second process when the water content in the oil is low than when the water content in the oil is high. In the above-described embodiment, as shown in FIG. 4, in the second process, the oil is not injected from the first oil jet 56. However, this is only an example. For example, in the second process, only the injection of oil from the first oil jet 56 may be limited. That is, the injection amount of the oil from the first oil jet 56 does not necessarily have to be zero.

In the above embodiments, the control device 100 comprises a CPU, RAM and a ROM. The control device 100 executes software processing. However, this is only an example. For example, the control device 100 may include dedicated hardware circuitry (e.g., ASIC, etc.) that processes at least a part of the software processes executed in the above-described embodiment. That is, the control device 100 may have any of the following configurations (a) to (c). (a) The control device 100 includes a processing device that executes all processes in accordance with a program, and a program storage device such as a ROM that stores a program. That is, the control device 100 includes a software execution device. (b) The control device 100 includes a processing device that executes a part of processing according to a program, and a program storage device. Furthermore, the control device 100 includes dedicated hardware circuits for executing the remaining processing. (c) The control device 100 includes a dedicated hardware circuit for executing all processes. Here, a plurality of software execution devices and/or dedicated hardware circuits may be provided. That is, the processing may be performed by a processing circuit (processing circuitry) including at least one of a software executing device and a dedicated hardware circuit. The processing circuit may include a plurality of software execution devices and dedicated hardware circuits. A program storage device or computer readable medium includes a storage device that is any available medium that can be accessed by a general purpose or special purpose computer.

What is claimed is:

1. A control device for an internal combustion engine, the control device comprising:

a first oil jet configured to spray, to cause oil to flow into a cavity extending through a piston, the oil toward a hole that is continuous with the cavity and is open to a back surface of the piston;

a second oil jet configured to spray the oil to a portion different from the hole on the back surface of the piston; and a processing circuit, wherein the processing circuit is configured to:

acquire a temperature of the piston;

determine whether the acquired temperature of the piston is equal to or higher than a predetermined temperature;

execute a first process for spraying the oil from the first oil jet when the acquired temperature of the piston is equal to or higher than the predetermined temperature; and execute a second process for restricting the spraying of the oil from the first oil jet and spraying the oil from the second oil jet when the acquired temperature of the piston is lower than the predetermined temperature.

2. The control device according to claim 1, wherein:

the processing circuit is configured to acquire a temperature of the oil; and the oil is sprayed from the second oil jet in the second process when the temperature of the piston is equal to or higher than the temperature of the oil.

3. The control device according to claim 1, wherein:

the processing circuit is configured to acquire a moisture content in the oil; and the oil is sprayed from the second oil jet in the second process when the moisture content in the oil is equal to or higher than a moisture content threshold.

4. The control device according to claim 1, wherein the processing circuit is configured to maintain a state in which the spraying of the oil from the first oil jet is stopped during the second process when the acquired temperature of the piston is lower than the predetermined temperature.

* * * * *